US008708750B2

(12) United States Patent
Ho

(10) Patent No.: US 8,708,750 B2
(45) Date of Patent: Apr. 29, 2014

(54) COMBO CONNECTOR

(75) Inventor: Yi-Tse Ho, Taipei Hsien (TW)

(73) Assignee: Molex Incorporated, Lisle, IL (US)

( * ) Notice: Subject to any disclaimer, the term of this patent is extended or adjusted under 35 U.S.C. 154(b) by 32 days.

(21) Appl. No.: 13/476,424

(22) Filed: May 21, 2012

(65) Prior Publication Data

US 2013/0059479 A1 Mar. 7, 2013

(30) Foreign Application Priority Data

May 20, 2011 (TW) ..... 100117762 A

(51) Int. Cl.
*H01R 25/00* (2006.01)

(52) U.S. Cl.
USPC ..... 439/639

(58) Field of Classification Search
USPC ..... 439/639, 347, 76.1, 638, 862, 350, 439/357–358, 631, 632
See application file for complete search history.

(56) References Cited

U.S. PATENT DOCUMENTS

| | | | | |
|---|---|---|---|---|
| 5,895,297 | A * | 4/1999 | Ivan | 439/712 |
| 6,746,279 | B1 * | 6/2004 | Lopez | 439/620.01 |
| 6,939,177 | B2 | 9/2005 | Kato et al. | |
| 7,491,095 | B1 * | 2/2009 | Huang | 439/682 |
| 8,418,219 | B1 * | 4/2013 | Parsons et al. | 725/151 |
| 2005/0202726 | A1 * | 9/2005 | Chou | 439/639 |
| 2010/0081334 | A1 * | 4/2010 | Kagotani | 439/639 |
| 2010/0136842 | A1 * | 6/2010 | Sakamoto et al. | 439/639 |

* cited by examiner

*Primary Examiner* — Jean F Duverne
(74) *Attorney, Agent, or Firm* — Stephen L. Sheldon

(57) ABSTRACT

A receptacle connector includes an insulative housing, at least three terminal groups and a metal shell. The insulative housing has a base and at least three tongue pieces which integrally extend from the base and are transversally spaced apart to each other and in which a tongue piece of the tongue pieces at a left side thereof belongs to a left tongue piece, a tongue piece of the tongue pieces at a right side thereof belongs to a right tongue piece, and the other of the tongue pieces between the left tongue piece and the right tongue piece belongs to a middle tongue piece. The metal shell surrounds the tongue pieces and defines a common mating space as well as a first and second mating space.

18 Claims, 7 Drawing Sheets

COMBO CONNECTOR

RELATED APPLICATIONS

This application claims priority to Taiwan Application No. 10117762, filed May 20, 2011, which is incorporated herein by reference in its entirety.

FIELD OF THE PRESENT INVENTION

The present application relates to a receptacle connector, and more specifically, to a receptacle connector with a plurality of mating spaces.

BACKGROUND OF THE PRESENT INVENTION

A receptacle connector, comprising a plurality of contacts, an insulator supporting the plurality of contacts, and a shell material, is disclosed by Taiwan patent publication No. TWI258897 (corresponding to a China patent application No. CN02141109.3 and an U.S. Pat. No. 6,939,177). The shell material forms a shell surrounding the plurality of the contact and the insulator and defining a connector interface. The distinguishing feature of the connector lies in that the shell material is further formed with a partition mechanism arranged to partition the connector interface into at least two interface portions, one of the interface portions has a shape different from a shape of another interface portion. Therefore, the connector may be used for mating with various types of mating connectors with different shapes of interface. According to a shape of the interface of the mating connector mating with the connector, the mating connector may engage one of the interface portions of the connector or a combination of the interface portions of the connector. For example, a mating connector with a large size may engage the entire connector interface, but a mating connector with a small size may engage one of the interface portions of the connector.

Although the partition mechanism may partition the connector interface into a plurality of interface portions, but the partition mechanism will occupy a certain space, so that a total length of the connector along a transversal direction becomes longer. There is an improved room in how to further decrease a volume of the connector.

SUMMARY OF THE PRESENT INVENTION

Accordingly, according to an aspect of the present application, a receptacle connector of the present application comprises: an insulative housing, at least three terminal groups and a metal shell. The insulative housing has a base and at least three tongue pieces which integrally extend from the base and are transversally spaced apart to each other and in which a tongue piece of the tongue pieces at a left side thereof belongs to a left tongue piece, a tongue piece of the tongue pieces at a right side thereof belongs to a right tongue piece, and the other of the tongue pieces between the left tongue piece and the right tongue piece belongs to a middle tongue piece. The at least three terminal groups are correspondingly provided on the tongue pieces respectively, in which a terminal group of the terminal groups provided in the left tongue piece belongs to a first terminal group, a terminal group of the terminal groups provided in the right tongue piece belongs to a second terminal group, at least one of the terminal groups provided in the middle tongue pieces belongs to a third terminal group. The metal shell is sheathed on the insulative housing and surrounds the tongue pieces and defines a common mating space; the metal shell has a top plate and a bottom plate which are opposite to each other and a left side plate and a right side plate which connect the top plate and the bottom plate; a first mating space is defined by the left side plate, a part of the top plate and a part of the bottom plate which connect the left side plate, and a left side face of the middle tongue piece adjacent to the left tongue piece; a second mating space is defined by the right side plate, a part of the top plate and a part of the bottom plate which connect the right side plate, and a right side face of the middle tongue piece adjacent to the right tongue piece; and the first mating space and the second mating space are portions of the common mating space respectively.

Preferably, the tongue pieces have different shapes respectively. Preferably, the third terminal group is a terminal group for transmitting power. The first terminal group is a terminal group conforming to an USB or USB-compatible signal transmission specification or a MicroUSB signal transmission specification, and the first mating space is a space for mating with an USB plug connector or an USB-compatible plug connector, or a MicroUSB plug connector. The second terminal group is a terminal group conforming to a HDMI or HDMI-compatible signal transmission specification or a MicroHDMI signal transmission specification, and the second mating space is a space for mating with a HDMI or HDMI-compatible plug connector, or a MicroHDMI plug connector.

Preferably, the metal shell further has an inserting piece provided at a middle section of the top plate and bending from the top plate toward the bottom plate and extending rearwardly, and the insulative housing further has a receiving slot provided in the base and correspondingly receiving the inserting piece.

According to another aspect of the present application, a receptacle connector of the present application comprises an insulative housing, at least three terminal groups and a metal shell. The insulative housing has a base and at least three tongue pieces which integrally extend from the base and are transversally spaced apart to each other and in which a tongue piece of the tongue pieces at a left side thereof belongs to a left tongue piece, a tongue piece of the tongue pieces at a right side thereof belongs to a right tongue piece, and the other of the tongue pieces between the left tongue piece and the right tongue piece belongs to a middle tongue piece. The least three terminal groups are correspondingly provided on the tongue pieces respectively in which a terminal group of the terminal groups provided in the left tongue piece belongs to a first terminal group, a terminal group of the terminal groups provided in the right tongue piece belongs to a second terminal group, at least one of the terminal groups provided in the middle tongue pieces belongs to a third terminal group. The metal shell is sheathed on the insulative housing and surrounds the tongue pieces and defines a common mating space for mating with a common plug connector; the metal shell has a top plate and a bottom plate which are opposite to each other and a left side plate and a right side plate which connect the top plate and the bottom plate; a first mating space is defined by the left side plate, a part of the top plate and a part of the bottom plate which connect the left side plate, and a left side face of the middle tongue piece adjacent to the left tongue piece; the first mating space is for mating with and limiting a first plug connector; a second mating space is defined by the right side plate, a part of the top plate and a part of the bottom plate which connect the right side plate, and a right side face of the middle tongue piece adjacent to the right tongue piece; the second mating space is for mating with and limiting a second plug connector; and the first mating space and the second mating space are portions of the common mating space respectively.

According to still another aspect of the present application, a receptacle connector of the present application comprises: an insulative housing, at least two terminal groups and a metal shell. The insulative housing has a base and at least two tongue pieces which integrally extend from the base and are transversally spaced apart to each other. The at least two terminal groups respectively are different types and are correspondingly respectively provided in the tongue pieces. The metal shell is sheathed on the insulative housing and surrounds the tongue pieces and defines a common mating space, the metal shell has a top plate and a bottom plate which are opposite to each other and two opposite side plates which connect the top plate and the bottom plate; and an independent space is defined by at least one side plate of the side plates, a part of the top plate and a part of the bottom plate which connect the at least one side plate, and a side face of the tongue piece sub-adjacent to the at least one side plate. "The tongue piece sub-adjacent to the at least one side plate" is a tongue piece adjacent to a tongue piece located in the independent mating space.

BRIEF DESCRIPTION OF THE DRAWINGS

The present invention is illustrated by way of example and not limited in the accompanying figures in which like reference numerals indicate similar elements and in which.

DESCRIPTION OF THE PREFERRED EMBODIMENTS

The foregoing and other technical contents, features and effects of the present application will be apparent through the following detailed description for a preferred embodiment in combination with the drawings.

Therefore, an object of the present application is to provide a receptacle connector having a plurality of independent mating spaces and capable of shortening a length thereof along a transversal direction. Effects of the application are as follows. The common mating space may be mated with common plug connector with a large size which is simultaneously mated with all the tongue pieces and is electrically connected to all the terminal groups; and the independent mating spaces (the first mating space and the second mating space) may correspondingly be mated with a first plug connector and a second plug connector respectively. Furthermore, one of boundaries of the independent mating spaces (the first mating space and the second mating space) is defined by a side face of a tongue piece adjacent to a tongue piece located in the independent mating spaces. In comparison with the conventional electrical connector in which a mating space is partitioned by a partition mechanism, a length dimension of the connector of the present application along the transversal direction may further be shortened.

Figure 1:
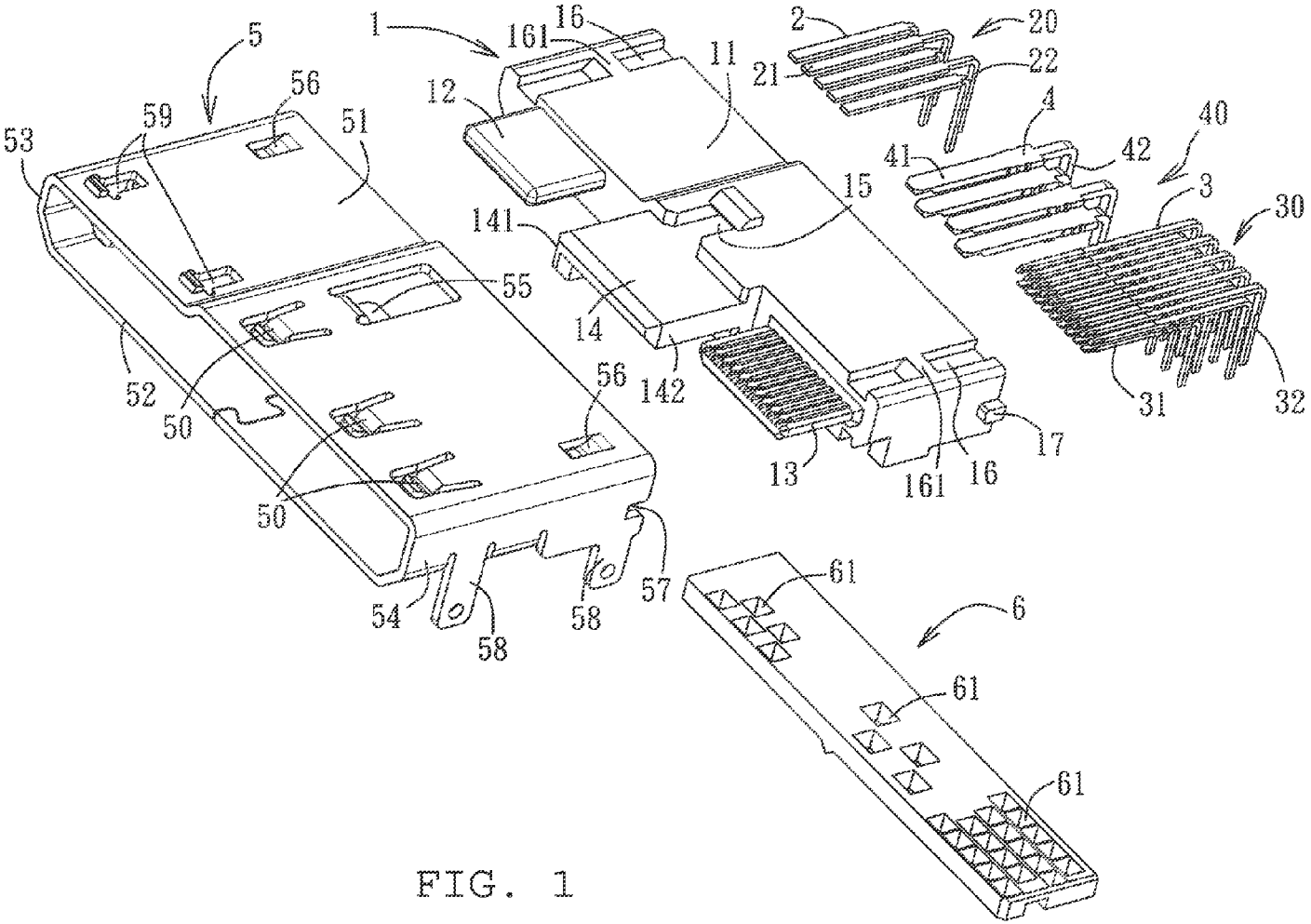
FIG. 1 is an exploded perspective view illustrating a receptacle connector of a preferred embodiment of the present application.
Figure 2:
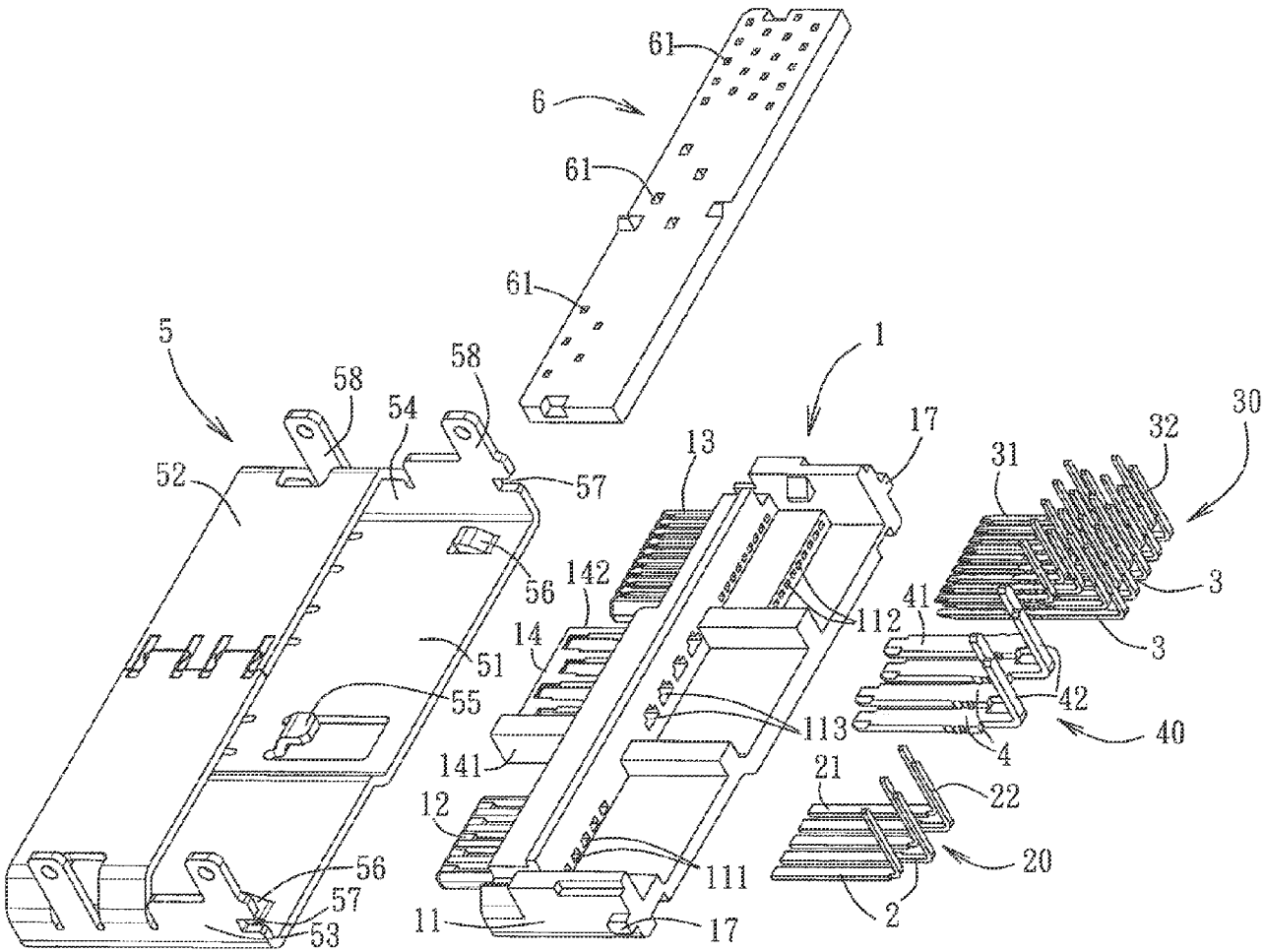
FIG. 2 is a view of FIG. 1 viewed from another view angle.
Figure 3:
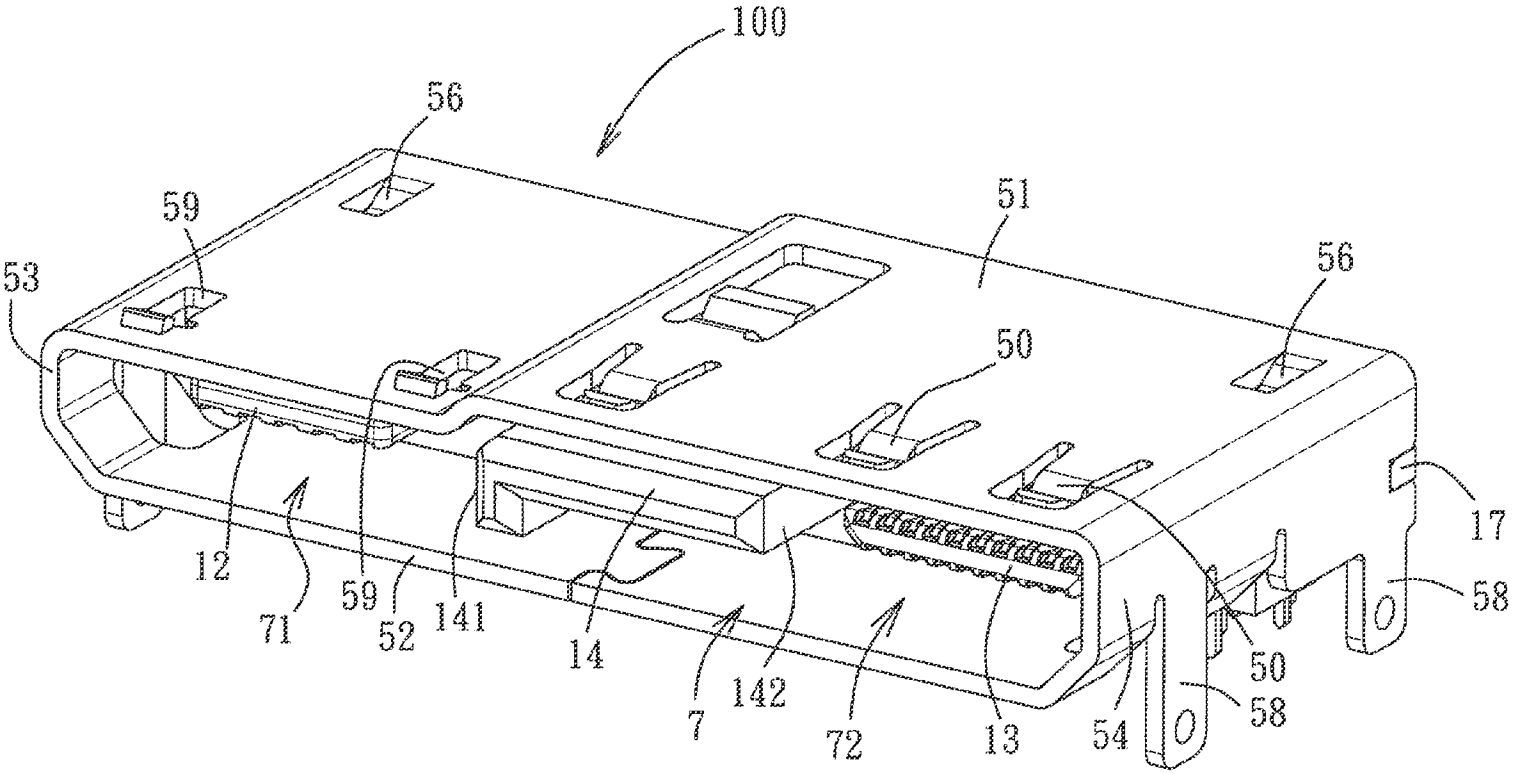
FIG. 3 is an assembly view of FIG. 1.

Referring to FIG. 1, FIG. 2 and FIG. 3, a receptacle connector 100 of a preferred embodiment of the present application comprises: an insulative housing 1, three terminal groups 20, 30, 40, a metal shell 5, and a terminal positioning member 6.

The insulative housing 1 has a base 11 and three tongue pieces 12, 13, 14 which integrally extend from the base 11 and are transversally spaced apart to each other in which a tongue piece of the tongue pieces at a left side thereof belongs to a left tongue piece 12, a tongue piece of the tongue pieces at a right side thereof belongs to a right tongue piece 13, and a tongue piece of the tongue pieces between the left tongue piece 12 and the right tongue piece 13 belongs to a middle tongue piece 14. The three tongue pieces have different shapes respectively, so as to correspondingly provide different types of terminal groups 20, 30, 40 therein.

The three terminal groups 20, 30, 40 are correspondingly provided in the tongue pieces 12, 13, 14 respectively in which a terminal group of the terminal groups 20, 30, 40 provided in the left tongue piece 12 belongs to a first terminal group 20, a terminal group of the terminal groups 20, 30, 40 provided in the right tongue piece 13 belongs to a second terminal group 30, a terminal group of the terminal groups 20, 30, 40 provided in the middle tongue pieces 14 belongs to a third terminal group 40. The first terminal group 20 is composed of a plurality of first terminals 2; each of the first terminals 2 is correspondingly fixedly provided in a terminal groove 111 of the base 11; each of the first terminals 2 has a contact portion 21 exposed on a lower surface of the left tongue piece 12 and a guide connection portion 22 extending out of the base 11 and bending downwardly. The second terminal group 30 is composed of a plurality of second terminals 3; each of the second terminals 3 is correspondingly fixedly provided in a terminal groove 112 of the base 11; each of the second terminals 3 has a contact portion 31 exposed on an upper surface or a lower surface of the right tongue piece 13 and a guide connection portion 32 extending out of the base 11 and bending downwardly. The third terminal group 40 is composed of a plurality of third terminals 4; each of the third terminals 4 is correspondingly fixedly provided in a terminal groove 113 of the base 11; each of the third terminals 4 has a contact portion 41 exposed on a lower surface of the middle tongue piece 14 and a guide connection portion 42 extending out of the base 11 and bending downwardly.

The metal shell 5 is sheathed on the insulative housing 1 and surrounding the tongue pieces 12, 13, 14 and defining a common mating space 7. And a first mating space 71 is defined by both a part of the metal shell 5 adjacent to the left tongue piece 12 and a left side face 141 of the middle tongue piece 14 adjacent to the left tongue piece 12 (referring to FIG. 8), a second mating space 72 is defined by both a part of the metal shell 5 adjacent to the right tongue piece 13 and a right side face 142 of the middle tongue piece 14 adjacent to the right tongue piece 13 (referring to FIG. 8), and the first mating space 71 and the second mating space 72 are portions of the common mating space 7 respectively. More specifically, the metal shell 5 has a top plate 51 and a bottom plate 52 which are opposite to each other and two opposite side plates 53, 54 which connect the top plate 51 and the bottom plate 52. For the sake of convenience, the two side plates 53, 54 are referred to as a left side plate 53 and a right side plate 54 respectively. Herein, the first mating space 71 (an independent mating space) is defined by the left side plate 53, a part of the top plate 51 and a part of the bottom plate 52 which connect the left side plate 53, and the left side face 141 of the middle tongue piece 14; the second mating space 72 (an independent mating space) is defined by the right side plate 54, a part of the top plate 51 and a part of the bottom plate 52 which connect the right side plate 54, and the right side face 142 of the middle tongue piece 14.

In the present embodiment, the three tongue pieces 12, 13, 14 are illustrated as an example, however, the number of the tongue pieces may also be two, four or more, which may be determined by specific requirement. If four or more tongue pieces are provided, it can be realized by increasing the number of the middle tongue piece based on the present embodiment. Similarly, a first mating space (an independent mating space) may be defined by the left side plate 53, a part of the top plate 51 and a part of the bottom plate 52 which connect the left side plate 53, and a left side face of the tongue piece sub-adjacent to the left side plate 53 (that is, one of the middle tongue pieces adjacent to the left tongue piece 53); and a second mating space (an independent mating space) may be defined by the right side plate 54, a part of the top plate 51 and a part of the bottom plate 52 which connect the right side plate 54, and a right side face of the tongue piece sub-adjacent to the right side plate 54 (that is, one of the middle tongue pieces adjacent to the right tongue piece 54). Similarly, if only two tongue pieces are provided, an independent mating space may be defined by one of the two side plates 53, 54, a part of the top plate 51 and a part of the bottom plate 52 which connect the one of the side plates 53, 54, and a side face of the tongue piece sub-adjacent to the one of the side plates 53, 54. More specifically, when only two tongue pieces are provided, an independent mating space may be defined by the left side plate 53, a part of the top plate 51 and a part of the bottom plate 52 which connect the left side plate 53 and a left side face of the tongue piece sub-adjacent to the left side plate 53 (that is, the right tongue piece); an independent mating space may also be defined by the right side plate 54, a part of the top plate 51 and a part of the bottom plate 52 which connect the right side plate 54, and a right side face of the tongue piece sub-adjacent to the right side plate 54 (that is, the left tongue piece); two kinds of the forgoing situations may also exist at the same time, so that there are two independent mating spaces which may be used respectively.

Figure 4:
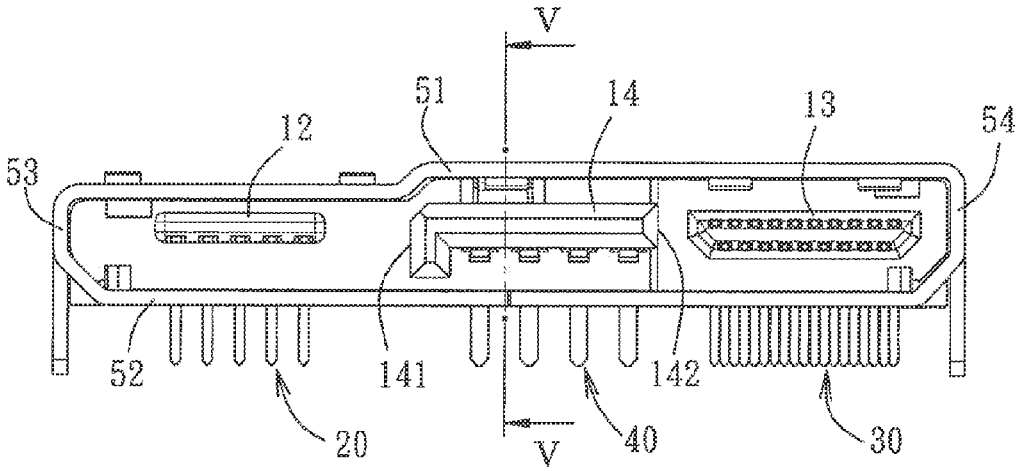
FIG. 4 is a front view of FIG. 3.
Figure 5:
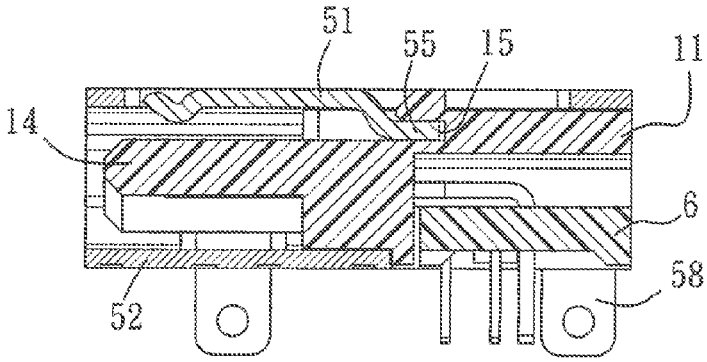
FIG. 5 is a cross sectional view along a V-V line of FIG. 4.

The metal shell 5 further has an inserting piece 55, two leaf springs 56, two engaging grooves 57 and four pins 58. The inserting piece 55 is provided at a middle section of the top plate 51 and bends from the top plate 51 toward the bottom plate 52 and extends rearwardly. The insulative housing 1 further has a receiving slot 15 provided in the base 11 and correspondingly receiving the inserting piece 55 (referring to FIG. 4 and FIG. 5). By inserting the inserting piece 55 into the receiving slot 15, strength of the metal shell 5 may be enforced. The two leaf springs 56 are respectively provided at two sides of the top plate 51; each of the leaf springs 56 bends from the top plate 51 toward the bottom plate 52 and extends forwardly. The two engaging grooves 57 are provided in the two side plates 53, 54 respectively and are concavely provided forwardly respectively from rear side edges of the side plates 53, 54. The insulative housing 1 further has two guiding channels 16 provided in a top face of the base 11 and respectively corresponding to the two leaf springs 56, two anti-stop blocks 161 correspondingly located in the two guiding channels 16 respectively, and two limiting blocks 17 provided at two sides of the base 11 respectively.

During assembly process, the terminal groups 20, 30, 40 are forwardly inserted into the insulative housing 1 from a rear side of the insulative housing 1, the metal shell 5 is rearwardly sheathed on the insulative housing 1 from a front side of the insulative housing 1. The leaf springs 56 of the metal shell 5 are engaged with the guiding channels 16 of the insulative housing 1 respectively, so that scrape between the leaf springs 56 and the insulative housing 1 may be deceased when the metal shell 5 and the insulative housing 1 are assembled (there is scrape only when the leaf springs 56 pass through the anti-stop blocks 161 respectively), therefore, it is convenient to assemble. The leaf springs 56 may compliantly flex upwardly when the leaf springs 56 pass through the anti-stop blocks 161 respectively, and front ends of the leaf springs 56 respectively extend downwardly into the guiding channels 16 and abut against rear wall faces of the anti-stop blocks 161 due to resilient force of the leaf springs 56 after the leaf springs 56 pass through the anti-stop blocks 161 respectively, so as to prevent the metal shell 5 from disengaging reversely (forwardly relative to the insulative housing 1) from the insulative housing 1. Moreover, by engaging the engaging grooves 57 of the metal shell 5 with the limiting blocks 17 of the insulative housing 1 respectively, the metal shell 5 is prevented from disengaging rearwardly from the insulative housing 1 relative to the insulative housing 1, that is to say, the metal shell 5 and the insulative housing 1 are relatively positioned along a front-rear direction. Moreover, the receptacle connector 100 is entirely secured on a circuit board (not shown) by the four pins 58 of the metal shell 5.

The terminal positioning plate 6 has a plurality of positioning holes 61 respectively corresponding to the guide connection portion 22, 32, 42 of the terminals 2, 3, 4. The terminal positioning plate 6 engages the insulative housing 1 and is used to pass through and position the guide connection portions 22, 32, 42.

In the present embodiment, the first terminal group 20 is a terminal group conforming to a MicroUSB signal transmission specification, or alternatively, may be a terminal group conforming to an USB (Universal Serial Bus) or USB-compatible signal transmission specification, for example, an USB2.0 or an USB3.0. The second terminal group 30 is a terminal group conforming to a MicroHDMI signal transmission specification, or alternatively, may be a terminal group conforming to a HDMI (High Definition Multimedia Interface) or HDMI-compatible signal transmission specification, or may be a terminal group conforming to a DP (Display Port) signal transmission specification. The third terminal group 40 is a terminal group for transmitting power, or alternatively, may be other type of a terminal group.

Figure 6:
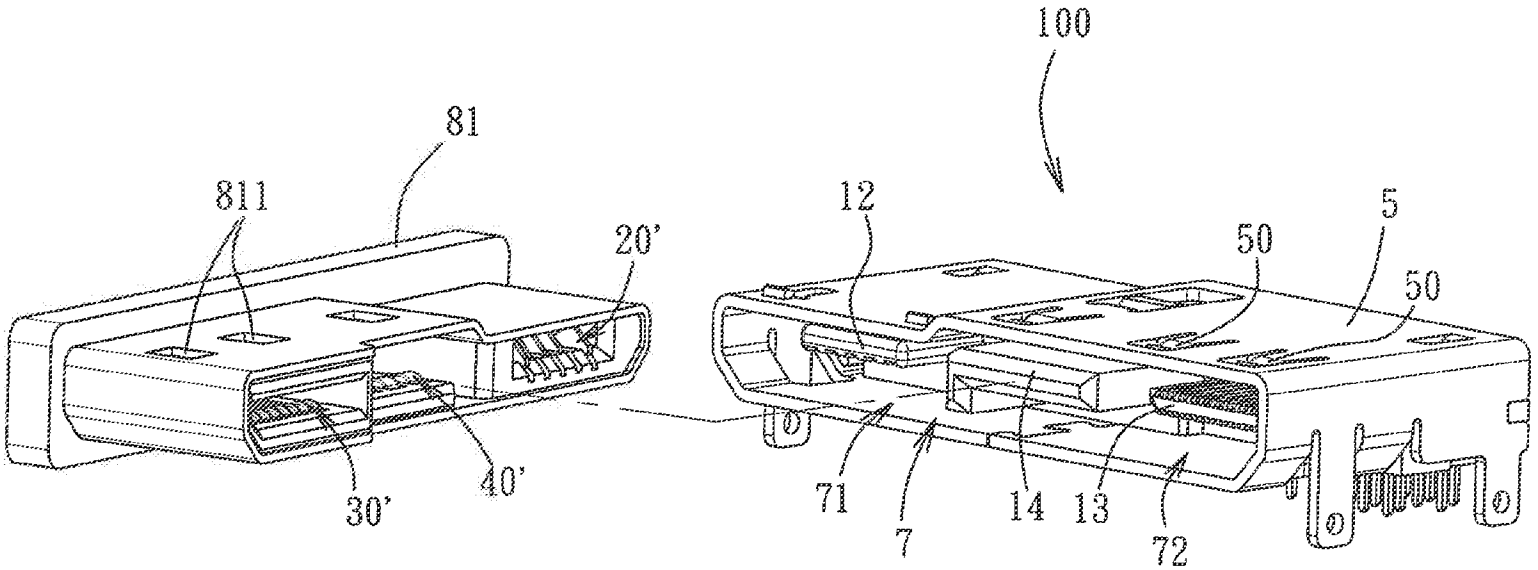
FIG. 6 is a perspective view illustrating the receptacle connector of the preferred embodiment and a plug connector mating with the receptacle connector.

Referring to FIG. 6, the common mating space 7, which is defined by the metal shell 5 entirely surrounding the insulative housing 1, may be used to mate with a common plug connector 81 with a large size. That is to say, the common plug connector 81 with the large size has conductive terminal groups 20', 30', 40' respectively corresponding to the terminal groups 20, 30, 40 so as to form respective electrical connections; and a metal shell of the plug connector 81 is provided with three through-holes 811 for respectively engaging the resilient arms 50 of the metal shell 5 of the receptacle connector 100 in a latching and retaining manner, so as to increase stability of the electrical connections.

Figure 7:
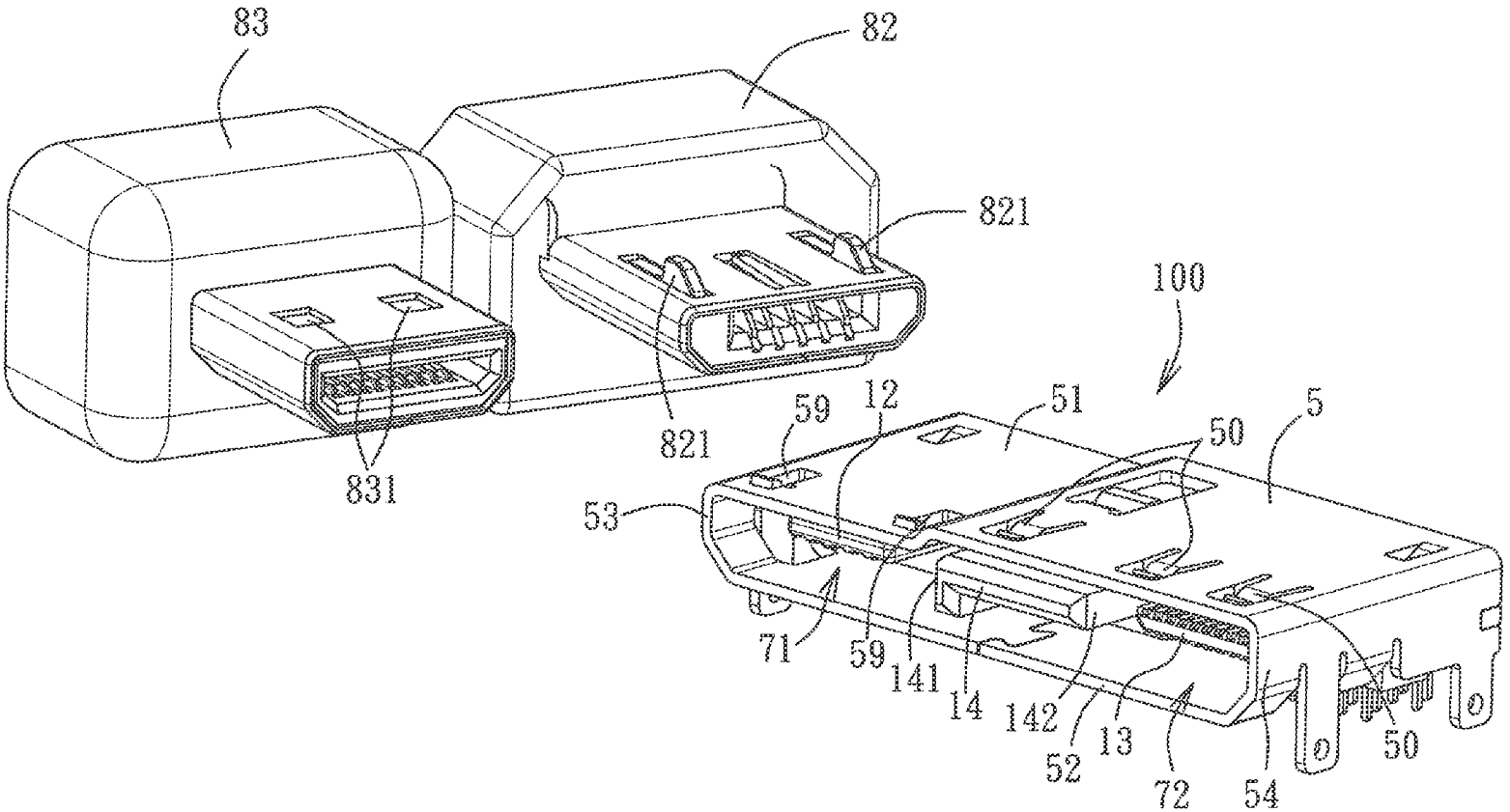
FIG. 7 is a perspective view illustrating the receptacle connector of the preferred embodiment and a first plug connector and a second plug connector mating with the receptacle connector.
Figure 8:
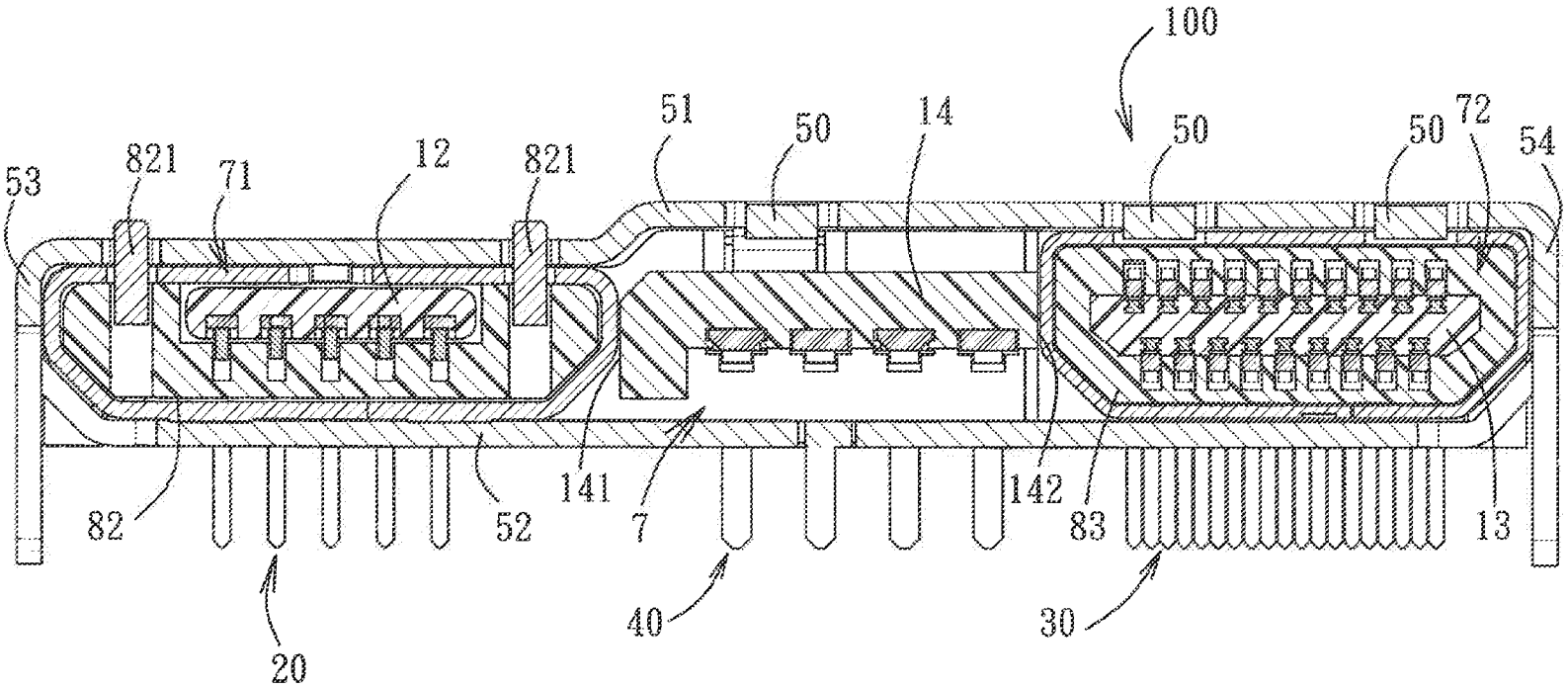
FIG. 8 is a cross sectional view illustrating an assembly relationship among the receptacle connector of the preferred embodiment, the first plug connector and the second plug connector.

Referring to FIG. 7 and FIG. 8, the left side plate 53 of the metal shell 5, a part of the top plate 51 and a part of the bottom plate 52 which connect the left side plate 53, and a left side face 141 of the middle tongue piece 14 together define a first mating space 71 centered around the left tongue piece 12; the first mating space 71 is a space for mating with the first plug connector 82 (which is a MicroUSB plug connector in this embodiment, or alternatively, may be an USB-compatible plug connector); a portion of the top plate 51 adjacent to the left tongue piece 12 is closer to the bottom plate 52 than other portion of the top plate 51, so that a flattened space is formed for corresponding to an appearance of the MicroUSB plug connector 82. And the metal shell 5 further has two latching holes 59 provided in the top plate 51 for respectively engaging resilient hooks 821 of the MicroUSB plug connector 82 in a latching and retaining manner so as to increase stability of electrical connection. The right side plate 54 of the metal shell 5, a part of the top plate 51 and a part of the bottom plate 52 which connect the right side plate 54, and the right side face 142 of the middle tongue piece 14 together define a second mating space 72 centered around the right tongue piece 13. The second mating space 72 is a space for mating with the second plug connector 83 (which is a MicroHDMI plug connector in this embodiment, or alternatively, may be a HDMI-compatible plug connector or a DP plug connector); and two resilient arms 50 above the right tongue piece 13 may respectively engage two through-holes 831 of the MicroHDMI plug connector 83 in a latching and retaining manner so as to increase stability of electrical connection. As shown in FIG. 8, when the MicroUSB plug connector 82 is mated with the left tongue piece 12 of the receptacle connector 100, the MicroUSB plug connector 82 is limited by the left side plate 53 of the metal shell 5, the part of the top plate 51 and the part of the bottom plate 52 which connect the left side plate 53, and the left side face 141 of the middle tongue piece 14. When the MicroHDMI plug connector 83 is mated with the right tongue piece 13 of the receptacle connector 100, the MicroHDMI plug connector 83 is limited by the right side plate 54 of the metal shell 5, the part of the top plate 51 and the part of the bottom plate 52 which connect the right side plate 54, and the right side face 142 of the middle tongue piece 14.

By the analogy of equivalent design ideas, a mating space for a plug connector mating with the middle tongue piece 14 may also be defined by a part of the top plate 51 and a part of the bottom plate 52 of the metal shell 5 adjacent to the middle tongue piece 14, a right side face of the left tongue piece 12, and a left side face of the right tongue piece 13.

According to the foregoing contents, the common mating space 7 may be mated with the common plug connector 81 with the large size which is mated with all the tongue pieces 12, 13, 14 and electrically connected to all the terminal groups 20, 30, 40 simultaneously; and the first mating space 71 and the second mating space 72 may be mated with the first plug connector 82 and the second plug connector 83 respectively. Moreover, one of boundaries of the independent mating space (which is the first mating space 71 or the second mating space 72 in this embodiment) is defined by a side face of the tongue piece adjacent to the independent mating space (which is the middle tongue piece in this embodiment). In comparison with the conventional electrical connector in which a mating space is partitioned by a partition mechanism, a length of the receptacle connector of the present application along a transversal direction may be further decreased.

What have been described above are only preferred embodiments of the present application, but it is not used to limit a scope for implementing the present application, that is to say, all equivalent changes and modifications devised according to the scope and the contents of the present application will be still fallen within the scope of the present application.

What is claimed is:

1. A receptacle connector comprising:

an insulative housing having a base and at least three tongue pieces which integrally extend from the base and are transversally spaced apart to each other and in which a tongue piece of the tongue pieces at a left side thereof belongs to a left tongue piece, a tongue piece of the tongue pieces at a right side thereof belongs to a right tongue piece, and the other of the tongue pieces between the left tongue piece and the right tongue piece belongs to a middle tongue piece;

at least three terminal groups correspondingly provided on the tongue pieces respectively in which a terminal group of the terminal groups provided in the left tongue piece belongs to a first terminal group, a terminal group of the terminal groups provided in the right tongue piece belongs to a second terminal group, at least one of the terminal groups provided in the middle tongue pieces belongs to a third terminal group; and a metal shell sheathed on the insulative housing and surrounding the tongue pieces and defining a common mating space; the metal shell having a top plate and a bottom plate which are opposite to each other and a left side plate and a right side plate which connect the top plate and the bottom plate; a first mating space being defined by the left side plate, a part of the top plate and a part of the bottom plate which connect the left side plate, and a left side face of the middle tongue piece adjacent to the left tongue piece; a second mating space being defined by the right side plate, a part of the top plate and a part of the bottom plate which connect the right side plate, and a right side face of the middle tongue piece adjacent to the right tongue piece; and the first mating space and the second mating space being portions of the common mating space respectively.

2. The receptacle connector according to claim 1, wherein the tongue pieces have different shapes respectively.

3. The receptacle connector according to claim 1, wherein the third terminal group is a terminal group for transmitting power.

4. The receptacle connector according to claim 3, wherein the first terminal group is a terminal group conforming to a specification selected from the group of an USB signal transmission specification and a MicroUSB signal transmission specification and the first mating space is a space for mating with, respectively, an USB plug connector or a MicroUSB plug connector.

5. The receptacle connector according to claim 3, wherein the second terminal group is a terminal group conforming to a specification selected from the group of an HDMI signal transmission specification and a MicroHDMI signal transmission specification and the second mating space is a space for mating with, respectively a HDMI plug connector or a MicroHDMI plug connector.

6. The receptacle connector according to claim 1, wherein the metal shell further has an inserting piece provided at a middle section of the top plate and bending from the top plate toward the bottom plate and extending rearwardly, and the insulative housing further has a receiving slot provided in the base and correspondingly receiving the inserting piece.

7. The receptacle connector according to claim 6, wherein a portion of the top plate adjacent to the left tongue piece is closer to the bottom plate than other portion of the top plate.

8. A receptacle connector comprising:

an insulative housing having a base and at least three tongue pieces which integrally extend from the base and are transversally spaced apart to each other and in which a tongue piece of the tongue pieces at a left side thereof belongs to a left tongue piece, a tongue piece of the tongue pieces at a right side thereof belongs to a right tongue piece, and the other of the tongue pieces between the left tongue piece and the right tongue piece belongs to a middle tongue piece;

at least three terminal groups correspondingly provided on the tongue pieces respectively in which a terminal group of the terminal groups provided in the left tongue piece belongs to a first terminal group, a terminal group of the terminal groups provided in the right tongue piece belongs to a second terminal group, at least one of the terminal groups provided in the middle tongue pieces belongs to a third terminal group; and a metal shell sheathed on the insulative housing and surrounding the tongue pieces and defining a common mating space for mating with a common plug connector; the metal shell having a top plate and a bottom plate which are opposite to each other and a left side plate and a right side plate which connect the top plate and the bottom plate; a first mating space being defined by the left side plate, a part of the top plate and a part of the bottom plate which connect the left side plate, and a left side face of the middle tongue piece adjacent to the left tongue piece; the first mating space being for mating with and limiting a first plug connector; a second mating space being defined by the right side plate, a part of the top plate and a part of the bottom plate which connect the right side plate, and a right side face of the middle tongue piece adjacent to the right tongue piece; the second mating space being for mating with and limiting a second plug connector; and the first mating space and the second mating space being portions of the common mating space respectively.

9. The receptacle connector according to claim 8, wherein the tongue pieces have different shapes respectively.

10. The receptacle connector according to claim 8, wherein the third terminal group is a terminal group for transmitting power.

11. The receptacle connector according to claim 10, wherein the first terminal group is a terminal group conforming to a specification selected from the group of an USB signal transmission specification and a MicroUSB signal transmission specification the first mating space is a space for mating with, respectively, an USB plug connector or a MicroUSB plug connector.

12. The receptacle connector according to claim 10, wherein the second terminal group is a terminal group conforming to a specification selected from the group of an HDMI signal transmission specification and a MicroHDMI signal transmission specification and the second mating space is a space for mating with, respectively a HDMI plug connector or a MicroHDMI plug connector.

13. The receptacle connector according to claim 8, wherein the metal shell further has an inserting piece provided at a middle section of the top plate and bending from the top plate toward the bottom plate and extending rearwardly and the insulative housing further has a receiving slot provided in the base and correspondingly receiving the inserting piece.

14. The receptacle connector according to claim 13, wherein a portion of the top plate adjacent to the left tongue piece is closer to the bottom plate than other portion of the top plate.

15. A receptacle connector comprising:

an insulative housing having a base and at least two tongue pieces which integrally extend from the base and are transversally spaced apart to each other;

at least two terminal groups respectively being different types and correspondingly respectively provided in the tongue pieces; and a metal shell sheathed on the insulative housing and surrounding the tongue pieces and defining a common mating space, the metal shell having a top plate and a bottom plate which are opposite to each other and two opposite side plates which connect the top plate and the bottom plate; and an independent space being defined by at least one side plate of the side plates, a part of the top plate and a part of the bottom plate which connect the at least one side plate, and a side face of the tongue piece subadjacent to the at least one side plate.

16. The receptacle connector according to claim 15, wherein the tongue pieces have different shapes respectively.

17. The receptacle connector according to claim 15, wherein one of the terminal groups is for transmitting power.

18. The receptacle connector according to claim 15, wherein the metal shell further has an inserting piece provided at a middle section of the top plate and bending from the top plate toward the bottom plate extending rearwardly and the insulative housing further has a receiving slot provided in the base and correspondingly receiving the inserting piece.

* * * * *